US008721132B2

(12) United States Patent
Beardsley et al.

(10) Patent No.: US 8,721,132 B2
(45) Date of Patent: May 13, 2014

(54) FLOW SENSING SYSTEM AND METHOD

(75) Inventors: Paul A. Beardsley, Zurich (CH); Martin M. Rufli, Winterhur (CH); Pirmin Mattmann, Udigenswil (CH)

(73) Assignee: Disney Enterprises, Inc., Burbank, CA (US)

( * ) Notice: Subject to any disclaimer, the term of this patent is extended or adjusted under 35 U.S.C. 154(b) by 243 days.

(21) Appl. No.: 13/287,329

(22) Filed: Nov. 2, 2011

(65) Prior Publication Data

US 2013/0106312 A1 May 2, 2013

(51) Int. Cl.
*F21V 15/00* (2006.01)
*F21V 19/02* (2006.01)

(52) U.S. Cl.
USPC ..... 362/362; 362/372

(58) Field of Classification Search
USPC ..... 362/362, 418, 372; 315/149–150, 315/152–153, 156; 340/4.42, 4.62, 5.2, 340/5.21, 561, 13.22, 13.24
See application file for complete search history.

(56) References Cited

U.S. PATENT DOCUMENTS

| | | | | |
|---|---|---|---|---|
| 2010/0141153 | A1* | 6/2010 | Recker et al. | 315/149 |
| 2010/0244706 | A1* | 9/2010 | Steiner et al. | 315/149 |
| 2010/0308736 | A1* | 12/2010 | Hung et al. | 315/149 |
| 2011/0101871 | A1* | 5/2011 | Schenk et al. | 315/149 |
| 2011/0248636 | A1* | 10/2011 | Liao | 315/149 |
| 2011/0260647 | A1* | 10/2011 | Catalano et al. | 315/294 |

OTHER PUBLICATIONS

Pixmob. Product description [online]. Eski, Inc., 2011 [retrieved on Nov. 2, 2011]. Retrieved from the Internet: <http://eskistudio.com/technologies/pixmob>.

Chris Lambright, "Art: 25 Years Strong in the SIGGRAPH '98 Gallery," Animation World Network—Siggraph 98 Special Report, 1998 [retrieved on Nov. 2, 2011]. Retrieved from the Internet: <http://www.awn.com/mag/issue3.5/siggraph/s98lambright.html>.

Munehiko Sato, "Particle Display System: A Real World Display with Physically Distributable Pixels," CHI Proceedings—Student Research Competition, Apr. 5-10, 2008, pp. 3771-3776.

Susanne Seitinger, et al., "Urban Pixels: Painting the City with Light," CHI 2009—Art Creation, Apr. 7, 2009, pp. 839-848.

* cited by examiner

*Primary Examiner* — Minh D A
(74) *Attorney, Agent, or Firm* — Marsh Fischmann & Breyfogle LLP; Kent A. Lembke; Kevin Duffy

(57) ABSTRACT

A visual display is provided through the combined effect of many devices that individually illuminate in response to wind flow. The devices are distributed at different locations within a three-dimensional space, so as to provide an overall illumination effect throughout the space that visually indicates wind (air) or other fluid flowing through the space. Each device can include a housing, at least one light source, a sensor system, and a device controller. The sensor system can include any of various types of sensor subsystems, each having one or more sensors, but includes at least a flow sensor subsystem. The device controller is configured to activate the light source in response to the sensor system detecting a change in an environmentally-related input, such as air flow, sensed by the sensor system.

34 Claims, 6 Drawing Sheets

FLOW SENSING SYSTEM AND METHOD

BACKGROUND

Illuminated large-scale displays that comprise a large number of individual illuminated elements may serve as works of art or to convey information. A stadium display is an example of a large-scale display that can convey both information and artistic visuals. Another type of large-scale display involves a system in which each person in a crowd holds an illumination device that can be wirelessly remotely controlled from a centralized controller. Such a system can be used to provide interesting visual effects using spectators in a darkened stadium or arena as "pixels" of a large-scale display. In another known system, a field of wall-mounted elements can be individually activated by infrared radiation, such as by shining a flashlight on them. In still another known system, a metal sculpture includes individual illumination elements resembling blades of grass that can be activated by air movement, such as a person blowing on them.

SUMMARY

Embodiments of the present invention relate to a flow sensing system and method for providing a display that individually illuminates a multiplicity of devices in response to environmental flow. In an exemplary embodiment, the flow sensing system includes a multiplicity of devices distributed at different locations within a three-dimensional space, so as to provide an overall illumination effect throughout the space that visually indicates wind (air) or other fluid flowing through the space. Each device can include a housing, at least one light source, a sensor system, and a device controller. The sensor system can include any of various types of sensor subsystems, each having one or more sensors, but includes at least a flow sensor subsystem. The device controller is configured to activate the light source in response to the sensor system detecting a change in an environmentally-related input, such as air flow, sensed by the sensor system.

Other systems, methods, features, and advantages of the invention will be or become apparent to one of skill in the art to which the invention relates upon examination of the following figures and detailed description. All such additional systems, methods, features, and advantages are encompassed by this description and the accompanying claims.

BRIEF DESCRIPTION OF THE FIGURES

The invention can be better understood with reference to the following figures. The elements shown in the figures are not necessarily to scale, emphasis instead being placed upon clearly illustrating the principles of the invention. Also, in the figures like reference numerals designate corresponding elements throughout the different views.

DETAILED DESCRIPTION

Figure 1:
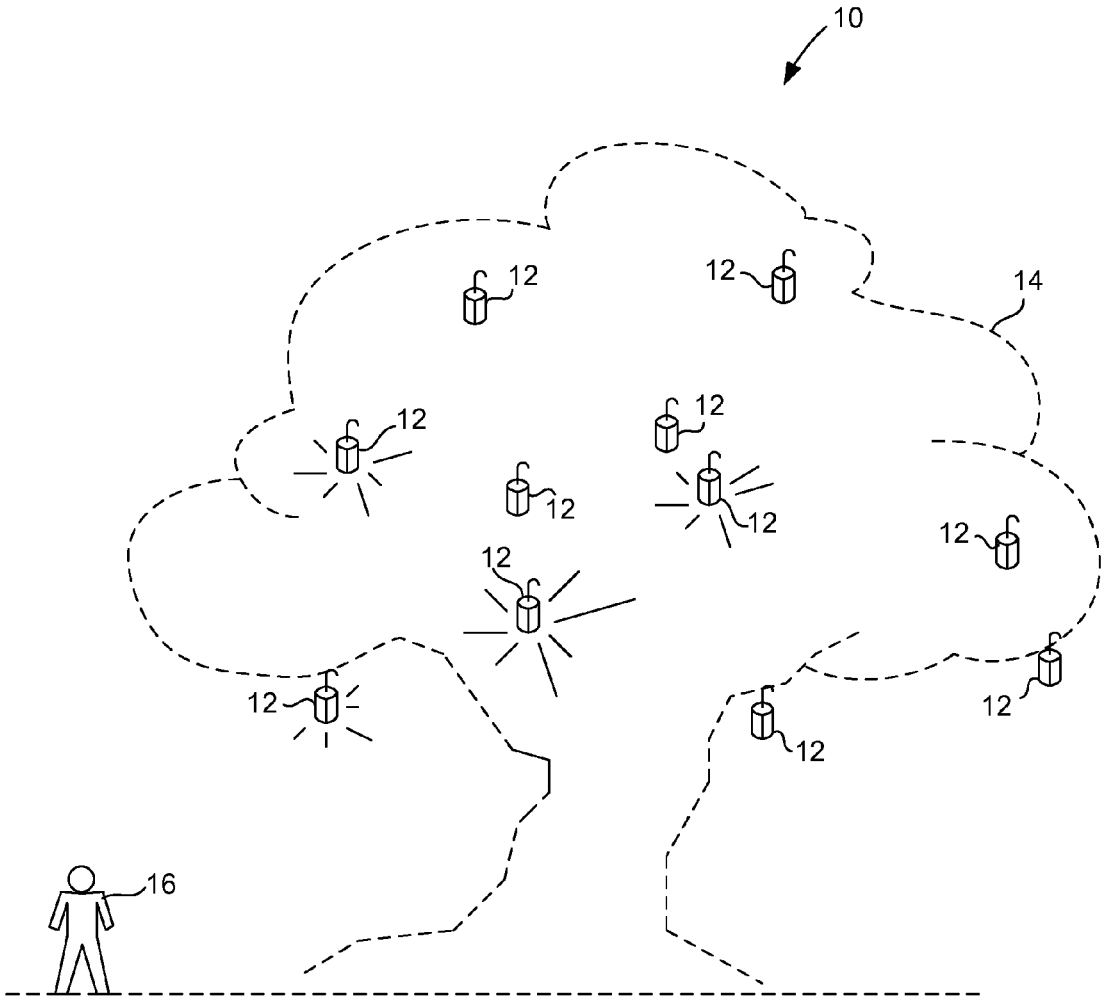
FIG. 1 illustrates a system in which a multiplicity of devices that can illuminate in response to sensed environmentally-related inputs are distributed throughout a tree, in accordance with an exemplary embodiment of the invention.

As illustrated in FIG. 1, in accordance with an illustrative or exemplary embodiment of the invention, a portion of a system 10 can include a multiplicity of devices 12 distributed at different locations within a three-dimensional space, such as the space occupied by the upper regions of a tree 14. The term "multiplicity" is used herein to refer to a quantity that is substantially greater than a plurality. As described below, the display of light produced by the multiplicity of devices 12 is somewhat analogous to a display of light produced by a multiplicity of pixels of an electronic display screen. That is, each of the devices 12 produces a pixel-like display of light that, in combination with the displays produced by all other devices 12 of the multiplicity, provides an overall effect to an observer 16 that is somewhat analogous to the effect of an electronic display screen that comprises a multiplicity of pixels. For purposes of clarity in FIG. 1, not all devices 12 of the multiplicity are shown. Note that FIG. 1 is not to scale.

Although in the exemplary embodiment the three-dimensional space in which devices 12 are distributed is the space occupied by the upper regions of tree 14, in other embodiments the three-dimensional space in which such devices are distributed can be any other suitable space or region. For example, in another embodiment the devices (not shown) can be distributed in the space occupied by a mechanical support structure (not shown). In still other embodiments the devices (not shown) can be distributed by attaching them to various different supports or structures within a three-dimensional space or region.

Figure 2A:
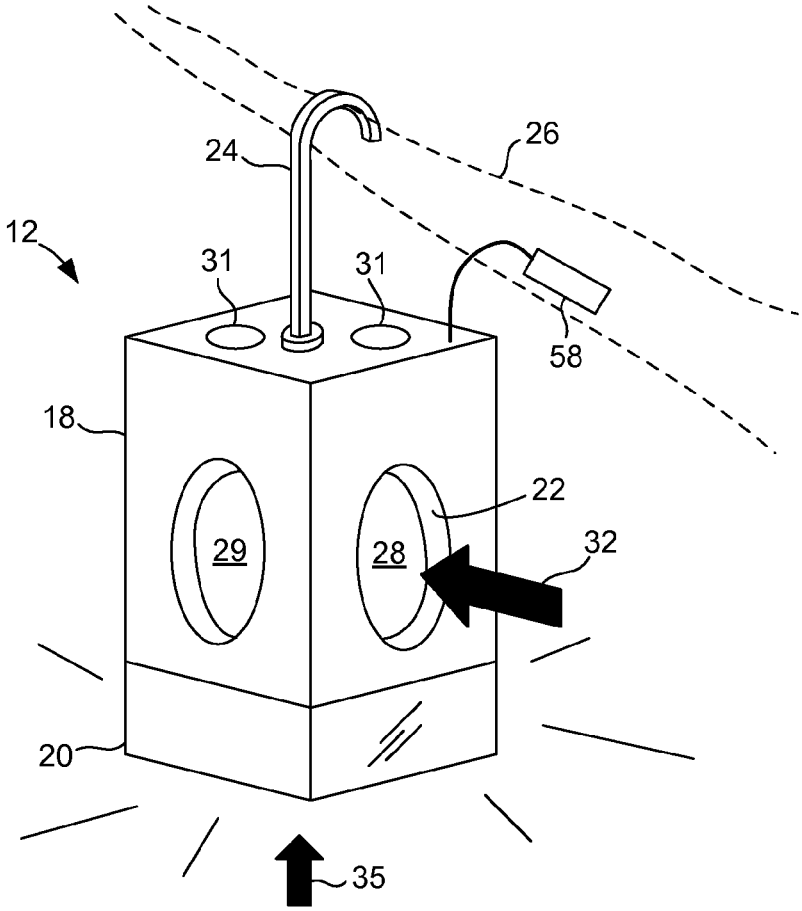
FIG. 2A is a perspective view of one of the devices shown in FIG. 1, in accordance with the exemplary embodiment.
Figure 2B:
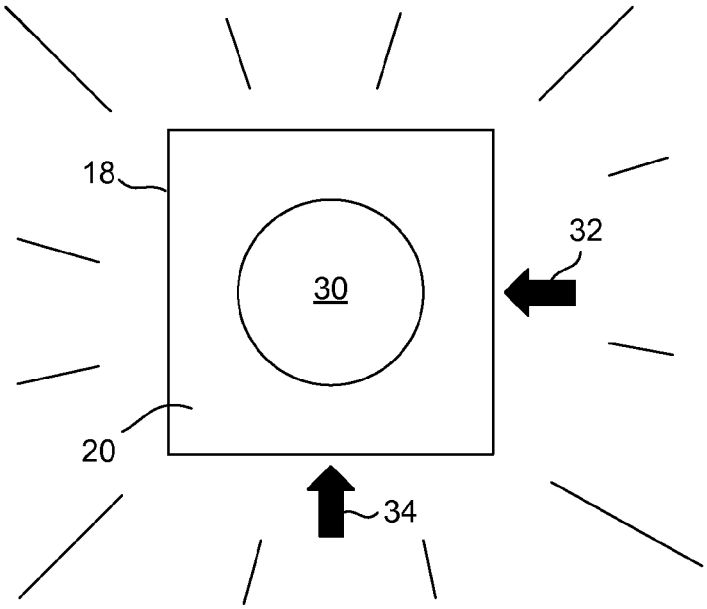
FIG. 2B is a bottom view of the device of FIG. 2A.

As illustrated in FIGS. 2A-B, in the exemplary embodiment each device 12 can include a housing 18, a light source 20 (only an exterior portion of which is shown in FIGS. 2A-B) coupled to housing 18, a sensor system 22 (only an exterior portion of which is shown in FIGS. 2A-B) coupled to housing 18, and an attachment member 24 for attaching device 12 to a tree branch 26 or other supporting structure. Device 12 can be of any suitable size. Although in the exemplary embodiment attachment member 24 has a hook-like end that can be placed over a tree branch, in other embodiments the attachment member can have a clamp (not shown) or any other suitable means for attaching the device to a tree branch, support, or other structure.

Openings 28, 29, 31 and 30 in housing 18 define portions of sensor system 22 for allowing air to flow through housing 18 in three mutually orthogonal directions. Although not shown for purposes of clarity, corresponding openings are located opposite openings 28 and 29 so that air can flow horizontally through housing 18. Likewise, openings 30 and 31 are located at opposite ends of housing 18 so that air can flow vertically through housing 18. Other portions of sensor system 22, which are not shown in FIG. 1 but located inside housing 18, can monitor for and detect a change in air flow entering housing 18 in horizontal directions 32 and 34 or in a vertical direction 35. (Although not indicated in FIGS. 2A-B, air can also flow through housing 18 in directions opposite those indicated by the arrows.) As a typical gust of wind may include components in two or more directions, such components may flow into housing 18 from more than one direction. It should be understood that the shapes, relative dimensions and arrangements of housing 18 and other elements of device 12 described above are intended only to be illustrative or exemplary.

Figure 3:
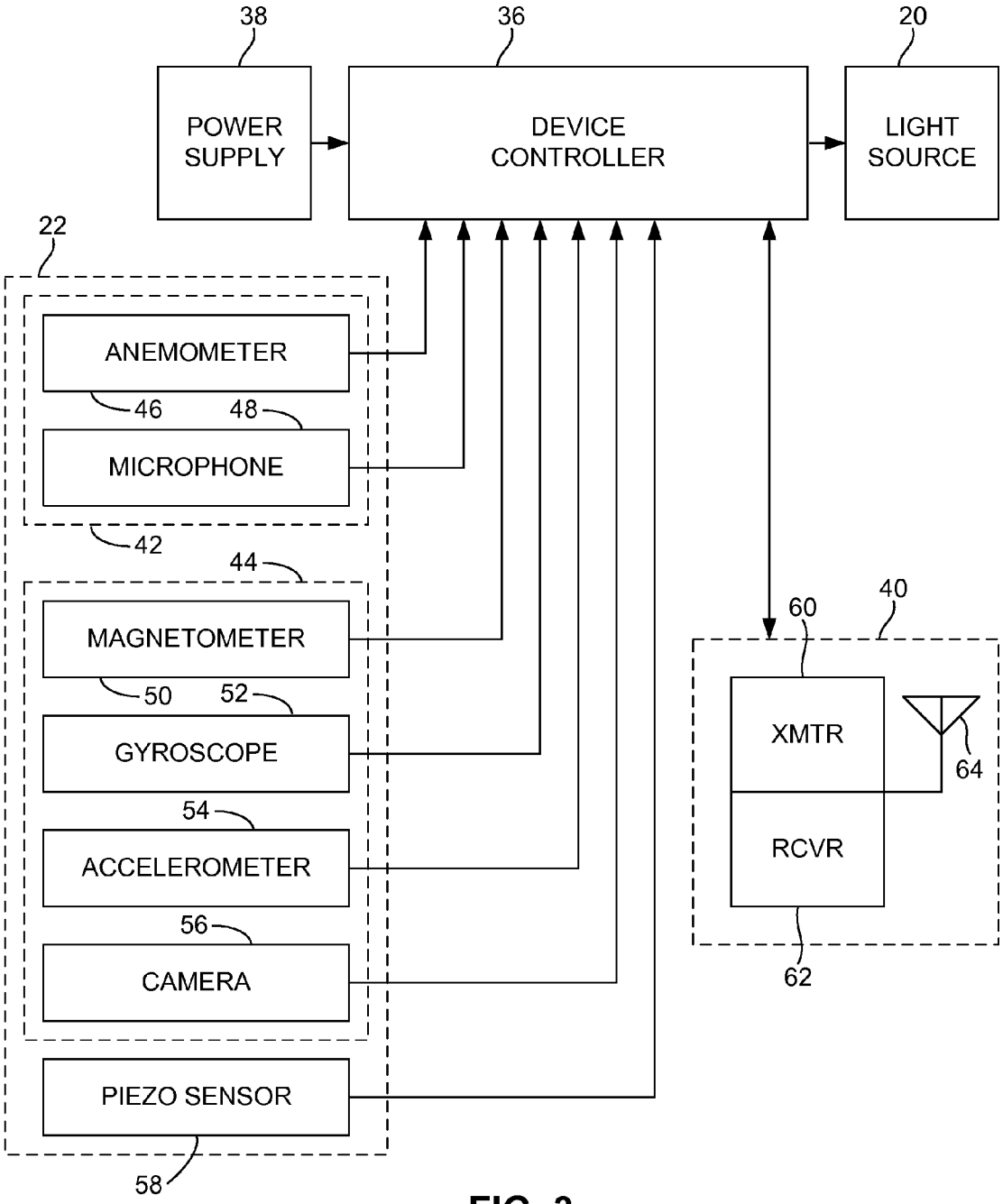
FIG. 3 is a block diagram of the device of FIGS. 2A-B, in accordance with the exemplary embodiment.

As illustrated in FIG. 3, internal elements of device 12 can further include a device controller 36, a power supply 38, and a wireless communication system 40. Although not shown for purposes of clarity, power supply 38 can include a battery mounted within housing 18 and a solar panel mounted on housing 18 for recharging the battery during daylight. Also, although for purposes of clarity power supply 38 is shown connected to only device controller 36, power supply 38 is also coupled to any other element of device 12 that requires power.

Sensor system 22 can sense and detect changes in one or more environmental inputs. In the exemplary embodiment, the environmental inputs include wind or air flow directed toward device 12 as well as the orientation of device 12 with respect to the environment in which device 12 is located. Accordingly, in the exemplary embodiment sensor system 22 includes an air flow sensor subsystem 42 and an orientation sensor subsystem 44.

In the exemplary embodiment, air flow sensor subsystem 42 includes the following sensors: an anemometer 46 and a microphone 48. Nevertheless, in other embodiments such an air flow sensor subsystem can include additional or different types of air flow sensors. Also, note that although in the exemplary embodiment only a single sensor of each of the above-referenced types is described, other embodiments can include more than one sensor of each such type. Although only the sensors of air flow sensor subsystem 42 are individually shown in FIG. 3, it should be understood that air flow sensor subsystem 42 can include additional mechanical, electronic or other devices and structures that interface the air flow sensors with device controller 36 or otherwise aid or contribute to the operation of the air flow sensors. As persons of ordinary skill in the art are capable of providing the sensors described herein, mounting the air flow sensors in housing 18 or otherwise coupling the air flow sensors to housing 18 in a suitable manner, interfacing the air flow sensors with device controller 36, and otherwise configuring device 12 to operate as described herein, such aspects of the exemplary embodiment are not described herein in further detail. Rather, the following can be noted about the air flow sensors of air flow sensor subsystem 42.

Anemometer 46 is mounted in housing 18 or otherwise coupled to housing 18 in a manner that enables anemometer 46 to measure air flow through openings 28, 29, 30, 31 and the openings that oppose openings 28 and 29 (FIGS. 2A-B). Anemometer 46 can be, for example, a 3-vane anemometer that measures wind speed as a vector in three dimensions. That is, anemometer 46 measures the mutually orthogonal x, y and z components of the wind flow, where directions 32 and 34 (FIG. 2A) are oriented along the x and y axes of a 3-dimensional reference system, respectively, and direction 35 (FIG. 2B) is oriented along the z axis of the reference system.

Microphone 48 is mounted in housing 18 or otherwise coupled to housing 18 in a manner that enables microphone 48 to sense the sound resulting from air flow (i.e., wind) past or through housing 18.

In the exemplary embodiment, orientation sensor subsystem 44 includes the following sensors: a compass or orientation magnetometer 50, a gyroscope 52, an accelerometer 54 and a camera 56. Nevertheless, in other embodiments such an orientation sensor subsystem can include additional or different types of orientation sensors. Also, note that although in the exemplary embodiment only a single sensor of each of the above-referenced types is described, other embodiments can include more than one sensor of each such type. Although only the sensors of orientation subsystem 44 are individually shown in FIG. 3, it should be understood that orientation sensor subsystem 44 can include additional mechanical, electronic or other devices and structures that interface the orientation sensors with device controller 36 or otherwise aid or contribute to the operation of the orientation sensors. As persons of ordinary skill in the art are capable of providing the orientation sensors described herein, mounting the orientation sensors in housing 18 or otherwise coupling the sensors to housing 18 in a suitable manner, interfacing the orientation sensors with device controller 36, and otherwise configuring device 12 to operate as described herein, such aspects of the exemplary embodiment are not described herein in further detail. Rather, the following can be noted about the orientation sensors of orientation sensor subsystem 44.

Magnetometer 50 is mounted in housing 18 or otherwise coupled to housing 18 in a manner that enables magnetometer 50 to sense the geographic direction in which housing 18 is oriented, in the manner of a compass. However, magnetometer 50 can alternatively be used to measure wind energy and wind velocity. For example, to measure wind energy, magnetometer 50 can be a 3DOF magnetometer that hangs inside housing 18 and thus behaves like a pendulum with respect to the motion of tree branch 26. The resting position of device 12 can be determined by computing the median value of readings from magnetometer 50 during periods of rest (as determined by low variation in the magnetometer readings). The subsystem oscillates when the wind blows. The upper point of the oscillation is detected as the point at which the magnetometer readings have the greatest difference from the resting position. This greatest difference can provide a measurement of wind energy at that instant.

Gyroscope 52 is mounted in housing 18 or otherwise coupled to housing 18 in a manner that enables gyroscope 52 to sense changes in orientation of housing 18. Gyroscope 52 may be based upon microelectromechanical structures (MEMS) technology or other suitable technology. Gyroscope 52 may of a single-axis type, a two-axis type, or a three-axis type.

Accelerometer 54 is mounted in housing 18 or otherwise coupled to housing 18 in a manner that enables accelerometer 54 to sense the quantity that is commonly known as "proper acceleration" or "g-force." A change in proper acceleration of housing 18 is indicative of a change in orientation of housing 18.

Camera 56 is mounted in housing 18 or otherwise coupled to housing 18 in a manner that enables camera 56 to capture images of the environment so that changes in the images can be sensed. A change in the captured image is indicative of a change in orientation of housing 18.

Piezoelectric sensor 58 is coupled to housing 18 in a manner that enables piezoelectric sensor 58 to sense the flexing of tree branch 26 (FIGS. 2A-B) or other support to which it is attached. Flexing of tree branch 26 is indicative of wind acting upon tree branch 26. Piezoelectric sensor 58 can be, for example, a tape-like membrane that can be attached to the surface of tree branch 26.

Light source 20 can include one or more individual sources of light, such as light-emitting diodes (LEDs), arranged in any suitable manner. In the exemplary embodiment, an external portion of light source 20 is located near the bottom of housing 18 (FIGS. 2A-B) so that the emitted light is most visible to observers who are located at or below the level of device 12. The one or more LEDs (not individually shown) can be mounted within housing 18 in an orientation in which they emit the light through a transparent or translucent window portion of light source 20. However, in other embodiments a light source can be integrated with a housing in any other suitable manner.

Light source 20 has a maximum useful range. That is, light source 20 can emit light that is visible to an average human observer from within a range of distances from light source 20 but not visible at substantially greater distances. In the system shown in FIG. 1, all of the multiplicity of devices 12 are located within this range of distances from at least one observation location (represented by observer 16). That is, observer 16 or others at such observation locations are generally able to see the light emitted by all of the multiplicity of devices that are distributed in the three-dimensional space, even though there may be additional devices 12 (not shown) that are not included in that multiplicity. Alternatively or in addition, in the system shown in FIG. 1 the multiplicity of devices 12 are distributed within the three-dimensional space at locations from which all devices 12 of that multiplicity emit light that is perceived by observer 16 or others at such observation locations to have substantially the same brightnesses. In summary, the multiplicity of devices 12 are not distributed so far apart from one another that they are not perceived by an observer as being part of the same overall display. Moreoever, none of the multiplicity of devices 12 is located so far apart from one or more others that it is effectively not visible due to its low perceived brightness relative to the perceived brightnesses of other devices 12 of the multiplicity.

In the exemplary embodiment, wireless communication system 40 includes a wireless transmitter 60, a wireless receiver 62, and an antenna 64. As described below, device controller 36 can cause information to be wirelessly communicated to and from (i.e, transmitted to and received from) other devices 12 or other transmitters and receivers. Although in the exemplary embodiment wireless communication system 40 is based upon radio frequency transmissions, in other embodiments such a wireless communication system can be based on any other suitable phenomena, such as infrared transmissions.

Device controller 36 can comprise any suitable logic, such as a microcontroller or microprocessor-based system. As persons of ordinary skill in the art are capable of providing and programming or configuring such logic to operate in the manner described herein, details of such aspects are not described herein. For example, persons of ordinary skill in the art are capable of programming or configuring such logic to operate in accordance with the flow diagrams of FIGS. 4 and 5.

Figure 4:
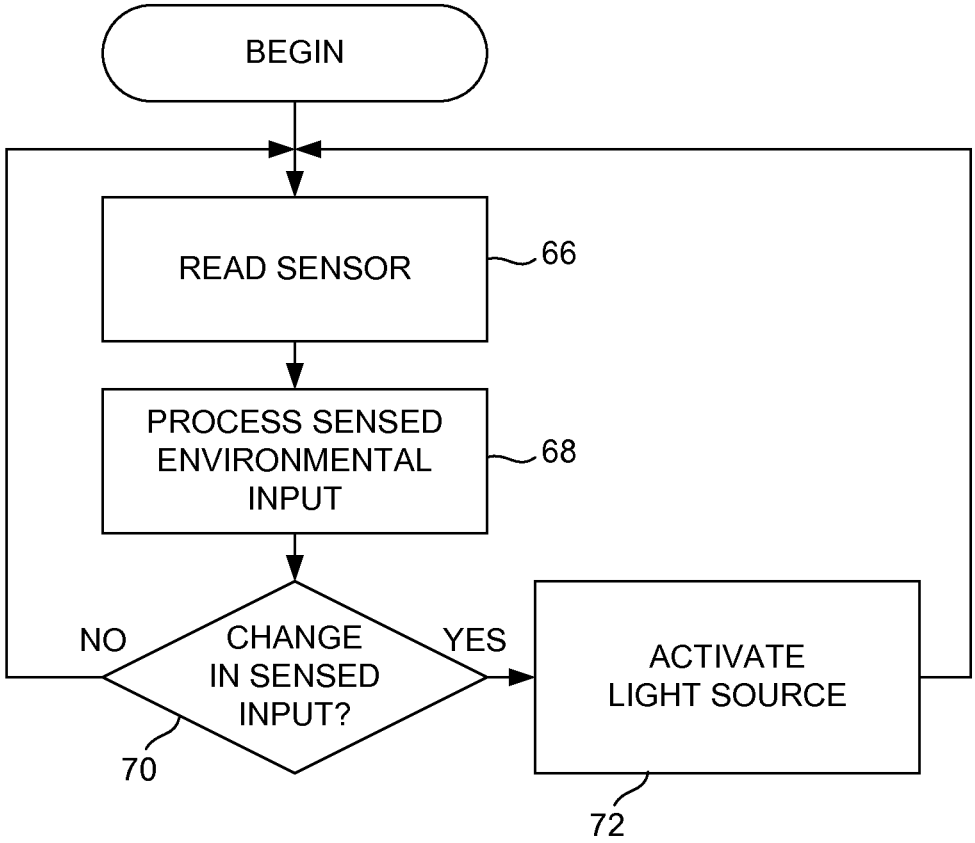
FIG. 4 is a flow diagram illustrating a method of operation of the system of FIG. 1, in accordance with the exemplary embodiment.

As indicated by block 66 in FIG. 4, operation of device 12 and system 10 (FIG. 1) can begin or continue with the reading of one or more sensors of sensor system 22 (FIG. 3). As described above, sensor system 22 provides a sensed environmental input to device controller 36. As indicated by block 68, device controller 36 or other element or combination of elements of device 12 can process the sensed environmental input. In the exemplary embodiment, the processing can include sensing whether there has been a change since a previous reading in any of the various environmental inputs sensed by the sensor system, such as air flow as sensed by anemometer 46 or microphone 48, or orientation as sensed by magnetometer 50, gyroscope 52, accelerometer 54, camera 56 or piezoelectric sensor 58. Such processing can include performing a logical "OR" of various indications representing potential change in the sensed environmental inputs, such that if it is determined that any of the various sensed environmental inputs has changed, a collective indication of change (i.e., a logic-"1" or affirmative indication) is produced. Other examples of suitable processing are described in further detail below. Still other examples will occur readily to persons of ordinary skill in the art in view of the teachings herein.

If, as indicated by block 70, a change in sensed environmental input is detected, such as indicated by the above-described collective indication of change, then device controller 36 activates light source 20, as indicated by block 72. Upon activation, light source 20 emits light. In an instance in which light source 20 is already activated at the time the determination indicated by block 70 is made, light source 20 continues to emit light. As described below, in more specific examples of processing and activation (block 72) of light source 20, light source 20 can be caused to emit light that is perceived as different from the light previously emitted, such as light of a different brightness (luminance) or color (wavelength). Thus, the phrase "to activate light source 20" or "activating light source 20" includes any action that affects the light emitted by light source 20. The sensing, processing, and activation steps described above can be performed on a periodic basis, such as, for example, every few milliseconds.

Figure 5:
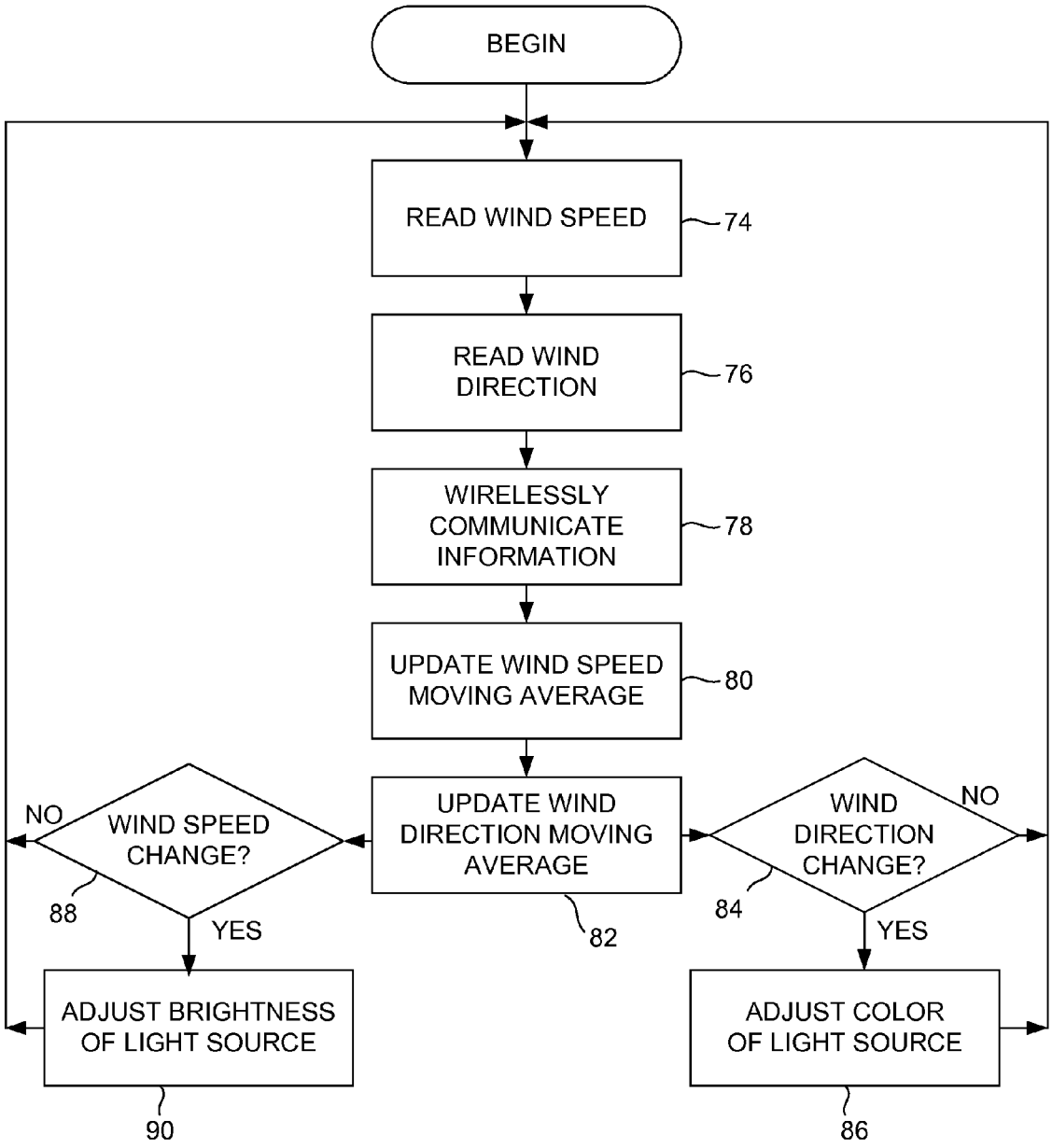
FIG. 5 is similar to FIG. 5, illustrating a method in further detail, in accordance with the exemplary embodiment.

As illustrated in FIG. 5, in a similar but more detailed example of a method of operation of device 12 and system 10 (FIG. 1), changes in the environmental inputs sensed by different sensors are used to affect different aspects of the light emitted by light source 20. Many other examples of operation of device 12 and system 10 will occur readily to persons of ordinary skill in the art in view of these teachings, such as embodiments in which the processing includes algorithms that use two or more of the sensed environmental inputs in combination with each other to determine how to change one or more aspects of the emitted light.

As indicated by block 74, device controller 36 (FIG. 3) can read wind speed using anemometer 46, microphone 42, or a combination of both. Similarly, as indicated by block 76, device controller 36 can read wind direction using one or more of magnetometer 50, gyroscope 52, accelerometer 54, camera 56 and piezoelectric sensor 58. Note that some of the sensors described herein as used for reading wind direction can also be used to determine wind speed by comparing successive readings. That is, the rate at which device 12 changes orientation may be indicative of wind speed.

Figure 6:
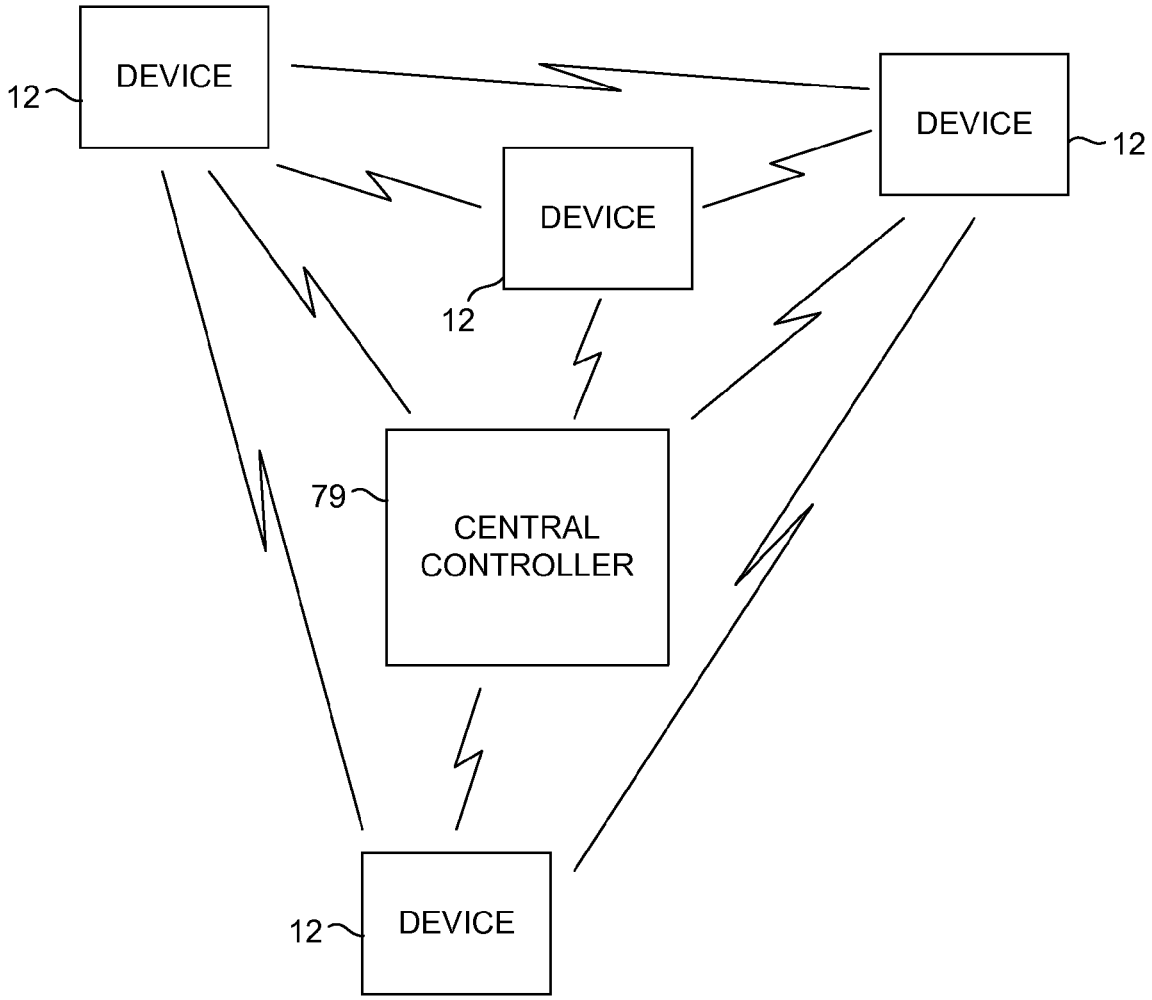
FIG. 6 illustrates the devices of FIG. 1 in wireless communication with each other and a central controller, in accordance with the exemplary embodiment.

As indicated by block 78, device 12 can wirelessly communicate information with other devices 12 or other transmitters and receivers. Referring briefly to FIG. 6, in the exemplary embodiment the multiplicity of devices 12 that are distributed within the three-dimensional space (FIG. 1) can wirelessly communicate information with each other and with a central controller 79. Central controller 79 can receive information, such as sensor readings, from one or more devices 12, process the information, and transmit a result of the processing to the devices 12 from which the sensor readings were received or other devices 12. In different embodiments, such processing in central controller 79 can range from all of the processing described with regard to FIG. 5 and other such computational processing, to little more than relaying the information to other devices 12. The following represent some examples of operation of central controller 79 in different embodiments.

In some embodiments, central controller 12 can provide a control signal to be transmitted to a corresponding device 12. That is, central controller 79 can control devices 12 individually. In such embodiments, each device 12 wirelessly receives a corresponding control signal and activates its light source 20 in response to the received control signal.

In other embodiments, central controller 79 acts as a relay or conduit through which each device 12 wirelessly receives the environmental input or other measurement information sensed by the sensor system 22 of at least one other device 12.

In such embodiments, each device 12 provides a control signal (at least in part) in response to the received measurement information and uses that control signal to activate its light source 20.

In still other embodiments, at least one device 12 of a first type produces a control signal in response to the measurement information that it senses. At least one other device 12 of a second type wirelessly receives the control signal from the first device 12 and uses that control signal to activate its light source 20. For example, a system can comprise many devices 12 of the second type that include light sources and wireless receivers but that economically do not include sensor systems.

Returning to FIG. 5, as indicated by block 80, device controller 36 (FIG. 3) can use the sensed wind speed to update a moving average of wind speed. In accordance with the alternative embodiments described above with regard to FIG. 6, the computation relating to the moving average can be performed by device controller 36 (i.e., of the same device 12 that sensed the wind speed), by another one of the devices 12, or by a combination thereof.

Similarly, as indicated by block 82, device controller 36 can use the sensed wind direction to update a moving average of wind direction. In accordance with the alternative embodiments described above with regard to FIG. 6, the computation relating to the moving average can be performed by device controller 36 (i.e., of the same device 12 that sensed the wind direction), by another one of the devices 12, or by a combination thereof.

A change in wind speed or wind direction can be determined by comparing the most recent measurement with the moving average. If, as indicated by block 84, device controller 36 determines that most recently sensed wind direction exceeds the moving average wind direction by more than a threshold amount, then device controller 36 can adjust the color of the light emitted by light source 20, as indicated by block 86. For example, each color of a predetermined set of colors can be assigned to indicate a specific geographic or compass direction, such as North, South, Southeast, Southwest, etc. If device controller 36 determines that most recently sensed wind direction is above or below the moving average by more than a threshold amount, then device controller 36 can adjust the color of the light emitted by light source 20 to indicate the most currently sensed direction.

Magnetometer 50 and the direction of gravity can be used to correlate wind direction with geographic direction, so that regardless of whether devices 12 are oriented in various geographic or compass directions all devices 12 will respond to the same wind direction by emitting the same color light. The magnetic field of the environment can be assumed to have the same direction across all devices 12, as a way to define a shared 3D coordinate frame S for the devices 12. At each device 12, the direction of the magnetic field, vector m, is computed when that device 12 is in its resting position and defines the x-axis of coordinate frame S. The cross-product of the vector m and the gravity vector g when the device is in its resting position defines the y-axis of S, and the cross-product of the x- and y-vectors determines the z-axis of S. An alternative choice is made in the particular case where vector m is parallel to vector g. All devices 12 now share a common alignment of their x-, y-, and z-axes (because the direction of the magnetic field and the direction of gravity are the same at all devices 12). All subsequent measurements of direction at a device 12 can be placed in the shared coordinate frame S. In the case where a device 12 has moved away from its resting position, magnetometer 50 defines the change in orientation relative to the resting position and hence relative to S.

The three vanes of anemometer 46 are orthogonal to one another and oriented at known orientations relative to magnetometer 50. The wind speed can be measured as s1, s2, s3 at each anemometer. The wind velocity is specified by the three vectors s1*d*1, s2*d*2, s3*d*3, where d1, d2, d3 are the unit vectors for the axes of the three anemometers in the shared coordinate frame S. The three vectors can be combined to determine the 3D vector for the wind velocity in the shared coordinate frame S. In still another alternative embodiment (not shown), a simpler system of two orthogonal vane anemometers can be used to determine wind velocity just in the 2D plane of those anemometers e.g. just in the horizontal plane.

If, as indicated by block 88, device controller 36 determines that the most recently sensed wind speed exceeds the moving average wind speed by more than a threshold amount, then device controller 36 can adjust the brightness of the light emitted by light source 20, as indicated by block 90. For example, each brightness level or step in a graduated set of brightness levels can indicate a corresponding wind speed. If device controller 36 determines that the most recently sensed wind speed exceeds the moving average by more than a threshold amount, then device controller 36 can correspondingly increase the brightness of the light emitted by light source 20. If device controller 36 determines that most recently sensed wind speed is below the moving average by more than a threshold amount, then device controller 36 can correspondingly decrease the brightness of the light emitted by light source 20.

As noted above, computations involving moving averages and adjustments of brightness and color are intended only as examples of processing of sensed environmental inputs and ways in which light sources can be activated. Other embodiments may process sensed environmental inputs in other ways that are in addition to or different from those described above. Various embodiments can include such processing and activation methods in any suitable combination with each other and with other features. For example, some embodiments may sense and process wind direction but not wind speed, while other embodiments may sense and process wind speed but not wind direction.

As a result of the system operation described above, an observer 16 (FIG. 1) can perceive an overall effect that is indicative of a three-dimensional wind field through tree 14 or other three-dimensional space in which the multiplicity of devices 12 are distributed. Observer 16 may perceive some areas of tree 14 becoming brighter than others or change colors in response to a gust of wind. The effect may be used to provide entertainment or for other purposes. Furthermore, the sensed environmental information may be collected through central controller 79 or other means and analyzed to help animators and others model the behavior of real trees in response to wind.

Also, while one or more embodiments of the invention have been described as illustrative of or examples of the invention, it will be apparent to those of ordinary skill in the art that other embodiments are possible that are within the scope of the invention. Accordingly, the scope of the invention is not to be limited by such embodiments but rather is determined by the appended claims.

What is claimed is:

1. A flow sensing system, comprising:

a multiplicity of devices distributed at different locations within a three-dimensional space, each of the devices comprising:

a housing;

a light source coupled to the housing and configured to emit visible light;

a sensor system coupled to the housing, the sensor system including an air flow sensor subsystem sensing an air flow rate through the housing; and a device controller coupled to the sensor system and the light source and configured to activate the light source in response to a change in the sensed air flow rate, which is greater than a predefined threshold amount, provided by the sensor system.

2. The flow sensing system of claim 1, further comprising a central controller having a wireless communication system, and wherein each device further comprises a wireless communication system configured to communicate with the wireless communication system of the central controller, wherein the central controller is configured to wirelessly receive measurement information sensed by the sensor system of each device and provide a plurality of control signals in response to the received measurement information, each control signal corresponding to one device, and wherein the device controller of each corresponding device is configured to wirelessly receive the corresponding control signal and activate the light source in response to the received control signal.

3. The flow sensing system of claim 1, wherein each device further comprises a wireless communication system configured to communicate with the wireless communication systems of others of the multiplicity of devices, wherein the device controller of each device is configured to wirelessly receive measurement information sensed by the sensor system of at least one other device and provide a control signal in response to the received measurement information, and wherein the device controller is configured to activate the light source in response to the control signal.

4. The flow sensing system of claim 1, wherein each device further comprises a wireless communication system configured to communicate with the wireless communication systems of others of the multiplicity of devices, wherein the device controller of at least one device is configured to wirelessly receive a control signal produced by at least one other device in response to measurement information sensed by the sensor system of the at the least one other device.

5. The flow sensing system of claim 4, wherein the at least one device does not include a sensor system.

6. The flow sensing system of claim 1, wherein the multiplicity of devices are mounted on a common structure.

7. The flow sensing system of claim 6, wherein the structure is a tree, and the multiplicity of devices are distributed among branches of the tree.

8. The flow sensing system of claim 1, wherein the air flow sensor subsystem comprises an anemometer.

9. The flow sensing system of claim 1, wherein the air flow sensor subsystem comprises a microphone.

10. The flow sensing system of claim 1, wherein the sensor system comprises an orientation sensor subsystem.

11. The flow sensing system of claim 10, wherein the orientation sensor subsystem comprises a magnetometer.

12. The flow sensing system of claim 10, wherein the orientation sensor subsystem comprises a gyroscopic sensor.

13. The flow sensing system of claim 10, wherein the orientation sensor subsystem comprises an accelerometer.

14. The flow sensing system of claim 10, wherein the orientation sensor subsystem comprises a camera.

15. The flow sensing system of claim 10, wherein the sensor system comprises a piezoelectric sensor.

16. The flow sensing system of claim 1, wherein:

the sensor system comprises an anemometer and a magnetometer; and the device controller is configured to activate the light source in response to a sensed flow direction provided by the sensor system, and light emitted by the light source has a color determined by wind direction relative to a direction of a magnetic field sensed by the magnetometer.

17. The method of claim 1, wherein, in response to the change in the sensed air flow rate exceeding the predefined threshold amount, the device controller adjusts the light source to increase or decrease the brightness of light being emitted by the light source.

18. A flow sensing device, comprising:

a housing;

a light source coupled to the housing and configured to emit light visible from within a range of distances from the light source;

a sensor system coupled to the housing, the sensor system sensing a wind direction based on air flow through the housing or an orientation of the housing; and a device controller coupled to the sensor system and the light source and configured to activate the light source in response to a change in the wind direction, provided by the sensor system, greater than a predefined threshold amount.

19. The device of claim 18, further comprising a wireless transmitter configured to wirelessly transmit a signal in response to information sensed by the sensor system.

20. The device of claim 18, further comprising a wireless receiver configured to wirelessly receive a control signal, wherein the device controller is configured to activate the light source in response to the control signal.

21. The device of claim 18, wherein the air flow sensor subsystem comprises an anemometer.

22. The device of claim 18, wherein the air flow sensor subsystem comprises a microphone.

23. The device of claim 18, wherein the sensor system comprises an orientation sensor subsystem.

24. The device of claim 23, wherein the orientation sensor subsystem comprises a magnetometer.

25. The device of claim 23, wherein the orientation sensor subsystem comprises a gyroscopic sensor.

26. The device of claim 23, wherein the orientation sensor subsystem comprises an accelerometer.

27. The device of claim 23, wherein the orientation sensor subsystem comprises a camera.

28. The device of claim 23, wherein the sensor system comprises a piezoelectric sensor.

29. The device of claim 18, wherein the sensor system comprises an a magnetometer and the device controller is configured to activate the light source to adjust a color of light emitted by the light source with the color determined by wind direction relative to a direction of a magnetic field sensed by the magnetometer.

30. The method of claim 18, wherein, in response to the change in the sensed wind direction exceeding the predefined threshold amount, the device controller changes a color of light emitted by the light source from a first color to a second color.

31. A method for providing an illuminated flow sensing display, comprising:

distributing a multiplicity of devices at different locations within a three-dimensional space, each device comprising:

a housing;

a light source coupled to the housing and configured to emit visible light;

a sensor system coupled to the housing, the sensor system including an orientation sensor subsystem and an air flow sensor subsystem; and a device controller coupled to the sensor system and the light source and configured to adjust a color of light emitted from the light source in response to change in a sensed wind direction input provided by the air flow sensor subsystem and to determination of a geographic orientation of the housing from data provided by the orientation sensor subsystem.

32. A flow sensing system, comprising:

a housing;

a light source coupled to the housing and configured to emit visible light;

a sensor system coupled to the housing, the sensor system sensing wind speed and geographic orientation of the housing; and a device controller coupled to the sensor system and the light source, wherein the device controller is configured to adjust a brightness of the light source in response to a change in the sensed wind speed as measured by the sensor system, and wherein the device controller is configured to adjust a color of the light source in response to a change in the geographic orientation of the housing as measured by the sensor system.

33. The flow sensing system of claim 32, wherein the device controller is further configured to determine the geographic orientation of the housing based on output of a magnetometer positioned in or on the housing and wherein the device controller is configured to select the color of the light source based on the geographic orientation.

34. The flow sensing system of claim 33, wherein the magnetometer is a three degrees of freedom magnetometer suspended inside the housing.

* * * * *